US008016562B2

(12) United States Patent
Gu

(10) Patent No.: US 8,016,562 B2
(45) Date of Patent: Sep. 13, 2011

(54) TURBINE BLADE TIP COOLING SYSTEM

(75) Inventor: Xubin Gu, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1214 days.

(21) Appl. No.: 11/942,885

(22) Filed: Nov. 20, 2007

(65) Prior Publication Data

US 2009/0129934 A1 May 21, 2009

(51) Int. Cl.
*F01D 5/20* (2006.01)

(52) U.S. Cl. ..... 416/97 R

(58) Field of Classification Search ..... 416/97 R, 416/96 R, 92, 228

See application file for complete search history.

(56) References Cited

U.S. PATENT DOCUMENTS 5,125,798 A 6/1992 Muth et al.
5,503,527 A 4/1996 Lee et al.
5,511,946 A * 4/1996 Lee et al. ..... 416/97 R
5,733,102 A 3/1998 Lee et al.
5,927,946 A 7/1999 Lee
6,039,531 A 3/2000 Suenaga et al.
6,059,530 A 5/2000 Lee
6,190,129 B1 2/2001 Mayer et al.
6,224,336 B1 5/2001 Kercher
6,761,539 B2 7/2004 Cipelletti et al.
6,929,054 B2 8/2005 Beals et al.
7,597,539 B1 * 10/2009 Liang ..... 416/97 R
2006/0088420 A1 4/2006 Lee

FOREIGN PATENT DOCUMENTS

JP 2002195003 7/2002

* cited by examiner

*Primary Examiner* — Richard Edgar

(57) ABSTRACT

A turbine blade for a turbine engine having a cooling system in the turbine blade including a camber-line rib extending radially outward from a tip of the blade and extending from a trailing edge of the blade toward a leading edge. The camber-line rib may form pressure and suction side cooling slots at the tip of the blade. The camber-line rib my include a cooling channel positioned in the camber-line rib and in fluid communication with the at least one cavity forming the cooling system in the blade for cooling aspects of the tip at the trailing edge.

11 Claims, 2 Drawing Sheets

TURBINE BLADE TIP COOLING SYSTEM

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Often times, localized hot spots form in the tip section of turbine blades. Thus, a need exists for removing excessive heat in the tip section of turbine blades.

SUMMARY OF THE INVENTION

This invention relates to a turbine blade cooling system for turbine blades used in turbine engines. In particular, the turbine blade cooling system includes a cavity positioned between two or more walls forming a housing of the turbine blade.

A camber-line rib may extend radially outward from a tip of the turbine blade at a trailing edge and may extend toward a leading edge of the turbine blade. One or more tip rib cooling channels may be positioned in the camber-line rib for cooling the tip of the turbine blade at and proximate to the trailing edge.

The turbine blade may be formed from a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade. A camber-line rib may extend radially outward from an outer surface of the tip of the generally elongated blade, beginning at the trailing edge of the blade and extending toward the leading edge. The camber-line rib may create a pressure side top slot on the pressure side of the camber-line rib, and the camber-line rib may create a suction side top slot on the suction side of the camber-line rib. At least one rib cooling channel may be positioned in the camber-line rib and may be in fluid communication with the at least one cavity forming the cooling system in the blade. The at least one rib cooling channel may include an exhaust opening in the trailing edge of the generally elongated blade for exhausting cooling fluids. In one embodiment, the exhaust opening may be in the trailing edge of the camber-line rib for exhausting cooling fluids. The turbine blade may include a forward tip rib extending radially from an outer surface of the tip of the generally elongated blade and at a perimeter of the blade such that a pocket is formed within the forward tip rib on the outer surface of the tip wall of the generally elongated blade, such that the forward tip rib contacts the camber-line rib at a leading edge of the camber-line rib.

The at least one rib cooling channel may be positioned along a centerline of the camber-line rib. The at least one rib cooling channel may include a linear portion that is aligned generally with a radially outer surface of the camber-line rib. The linear portion of the at least one rib cooling channel may be aligned radially with pressure and suction side top slots. The at least one rib cooling channel may also include a cooling fluid feed portion that is nonparallel and nonorthogonal relative to the linear portion of the at least one rib cooling channel and in direct contact with the at least one cavity forming a cooling system in the blade. The cooling fluid feed portion may be linear and may extend from the at least one cavity forming a cooling system in the blade to an outer surface of the camber-line rib. A plug may be positioned in the cooling fluid feed portion at the intersection of the cooling fluid feed portion and the outer surface of the camber-line rib to prevent the release of cooling fluids from the radial outer surface of the tip.

An advantage of this invention is that the camber-line rib is positioned at the camber-line of the tip, which enables it to be more effectively cooled by the rib cooling channel.

Another advantage of this invention is that the rib cooling channel is positioned in the camber-line rib and receives cooling fluids from internal cooling chambers in the turbine blade for cooling the camber-line rib and adjacent tip material.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
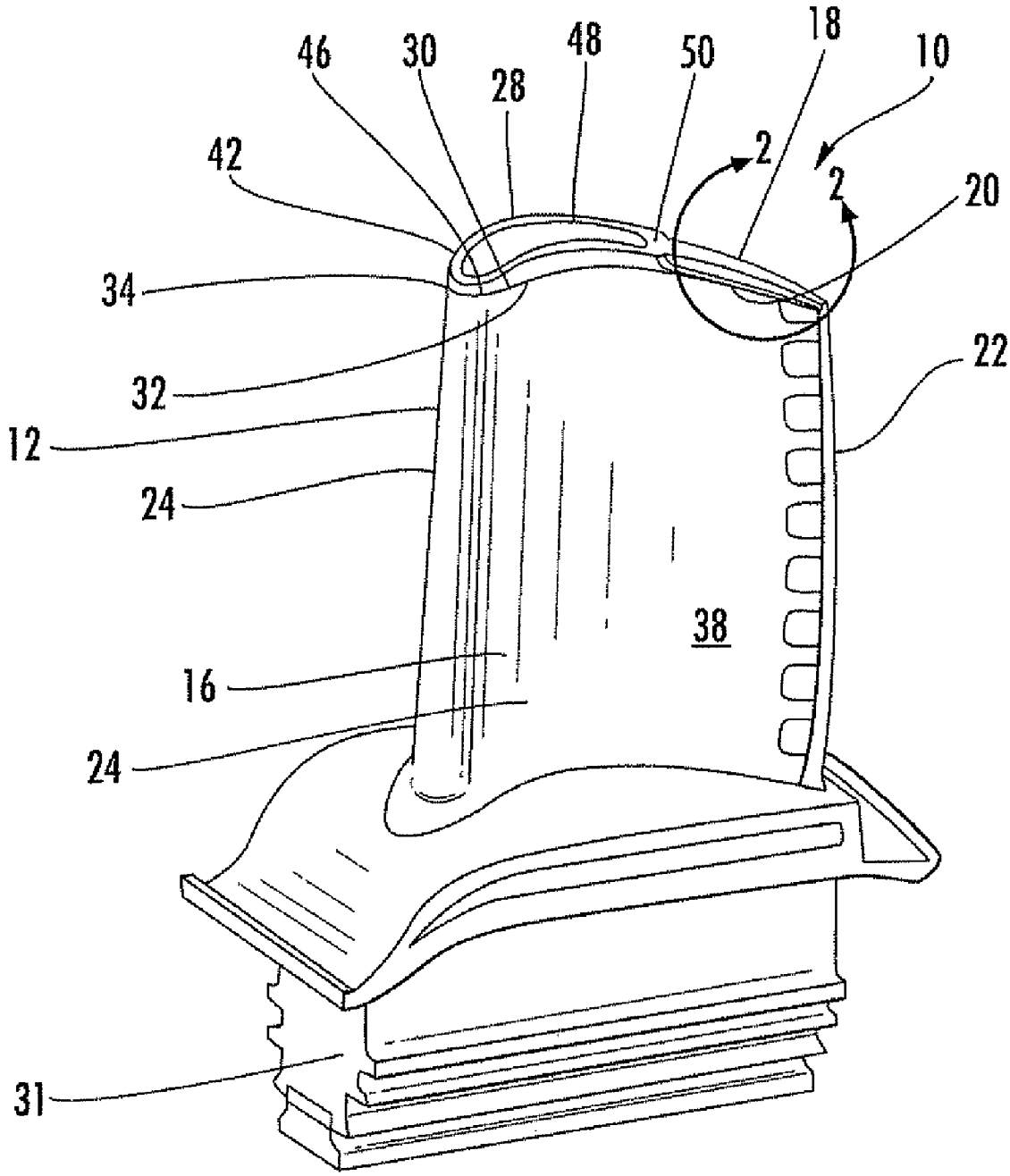
FIG. 1 is a perspective view of a turbine blade having features according to the instant invention.

As shown in FIGS. 1-41 this invention is directed to a turbine blade cooling system 10 for turbine blades 12 used in turbine engines. In particular, the turbine blade cooling system 10 includes a cavity 141 as shown in FIGS. 2 and 31 positioned between two or more walls forming a housing 16 of the turbine blade 12. A camber-line rib 18 may extend radially outward from a tip 20 of the turbine blade 12 at a trailing edge 22 and may extend toward a leading edge 24 of the turbine blade 12. One or more tip rib cooling channels 26 may be positioned in the camber-line rib 18 for cooling the tip 20 of the turbine blade 12 at the trailing edge 22.

Figure 2:
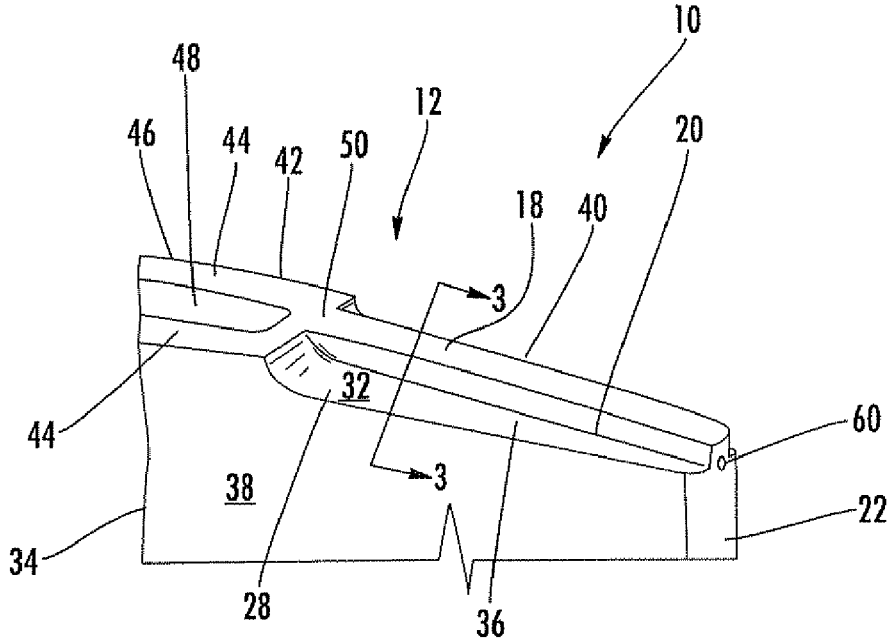
FIG. 2 is detailed perspective view of a portion of the tip of the turbine blade shown in FIG. 1 taken along line 2-2.
Figure 3:
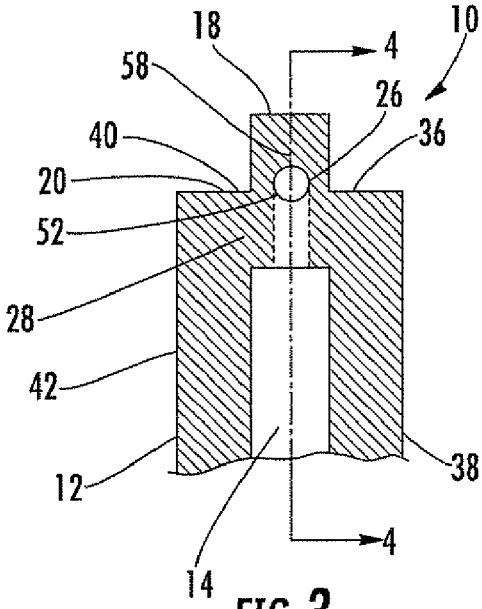
FIG. 3 is a partial cross-sectional view of the turbine blade shown in FIG. 1 taken along line 3-3.

As shown in FIG. 1, the turbine blade 12 may be formed from a generally elongated blade 34 having the leading edge 24, the trailing edge 22, a tip wall 28 at a first end 30, a root 31 coupled to the blade 34 at an end generally opposite the first end 30 for supporting the blade 34 and for coupling the blade 34 to a disc, and the at least one cavity 14 forming the cooling system 10 in the blade 18. The cooling system 10 may have any appropriate configuration within internal aspects of the elongated blade 34. The cooling system 10 is not limited to a particular configuration.

As shown in FIG. 2, the camber-line rib 18 may extend radially outward from an outer surface 32 of the tip 20 of the generally elongated blade 34, beginning at the trailing edge 22 of the blade and extending toward the leading edge 24. The camber-line rib 18 may create a pressure side top slot 36 on a pressure side 38 of the camber-line rib 18, and the camber-line rib 18 may create a suction side top slot 40 on a suction side 42 of the camber-line rib 18. The tip 20 may also include a forward tip rib 44 extending radially from the outer surface 32 of the tip 20 of the generally elongated blade 34 and at a perimeter 46 of the blade 34 such that a pocket 48 is formed within the forward tip rib 44 on the outer surface 32 of the tip wall 28 of the generally elongated blade 34, such that the forward tip rib 44 contacts the camber-line rib 18 at a leading edge 24 of the camber-line rib 18. The forward tip rib 44 and the camber-line rib 18 may have the same thickness and height. In another embodiment, the forward tip rib 44 and the camber-line rib 18 may have a different thickness or height, or both. The intersection 50 between the forward tip rib 44 and the camber-line rib 18 may be positioned from the trailing edge a distance between about one half and one quarter of the distance from the leading edge 24 to the trailing edge 22.

Figure 4:
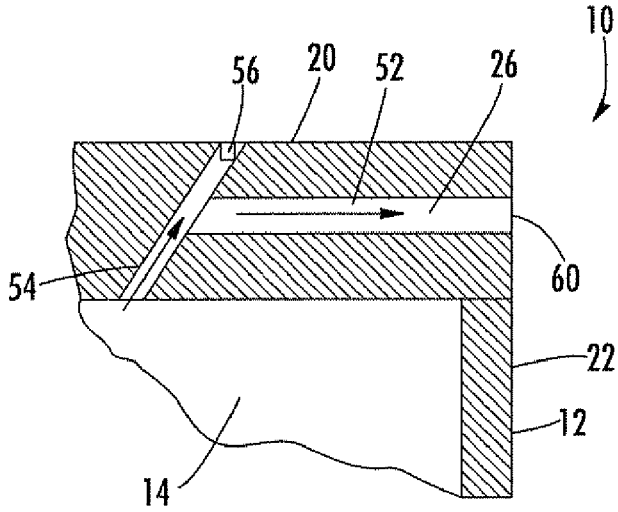
FIG. 4 is a partial cross-sectional view of the turbine blade shown in FIG. 3 taken along line 4-4.

The turbine blade 12 may include one or more rib cooling channels 26 positioned in the camber-line rib 18 and in fluid communication with the cavity 14 forming the cooling system 10 in the blade 12. The rib cooling channel 26 may have a length substantially equal to a length of the camber-line rib 18 or less. The rib cooling channel 26 may have a cross-section with a circular shape, an elliptical shape, an oval shape, or other appropriate shape. The cross-sectional shape of the rib cooling channel 26 may be the same throughout the length of the channel 26 or may vary. The rib cooling channel 26 may include a linear portion 52 that is aligned generally with a radially outer surface 32 of the camber-line rib 18. The rib cooling channel 26 may also include a cooling fluid feed portion 54 that may be nonparallel and nonorthogonal relative to the linear portion 52 of the rib cooling channel 26, as shown in FIG. 4, and in direct contact with the cavity 14 forming a cooling system 10 in the blade 12. The rib cooling channel 26 may include an exhaust opening 60 in the trailing edge 22 of the generally elongated blade 34 for exhausting cooling fluids. In one embodiment, the rib cooling channel 26 may include an exhaust opening 60 in the trailing edge 22 of the camber-line rib 18 for exhausting cooling fluids. In this configuration, cooling fluids may flow from the cavity 14 to the cooling fluid feed portion 547 into the linear portion 52 and out of the exhaust opening 60.

In one embodiment, as shown in FIG. 4, the cooling fluid feed portion 54 may be linear and may extend from the cavity 14 forming a cooling system 10 in the blade 12 to an outer surface 32 of the camber-line rib 18. The cooling feed portion 54 may be created by drilling the channel from the outer surface 32. The linear portion 52 may also be created by drilling. A plug 56, such as, but not limited to a weld, may be positioned in the cooling fluid feed portion 54 at the intersection 50 of the cooling fluid feed portion 54 and the outer surface 32 of the camber-line rib 18 to prevent cooling fluids from being exhausted radially outward from the camber-line rib 18. The linear portion 52 of the rib cooling channel 26 may be aligned radially with pressure and suction side top slots 86, 40. The rib cooling channel 26 may be positioned along a centerline 58 of the camber-line rib 18 to evenly distribute the cooling effects to the tip 20.

During operation, cooling fluids, which may be, but are not limited to, air, flow through into the cooling system 10 from the root 31. At least a portion of the cooling fluids flow into the cavity 14, and at least some of the cooling fluids flow into the rib cooling channel 26. The cooling fluids may first flow into the cooling fluid feed portion 54 of the rib cooling channel 26 and then into the linear portion 52 wherein the cooling fluids cool the camber-line rib 18. The cooling fluids may then be exhausted from the rib cooling channel 26 through the exhaust opening 60.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade;

a camber-line rib extending radially outward from an outer surface of the tip of the generally elongated blade, beginning at the trailing edge of the blade and extending toward the leading edge, whereby the camber-line rib creates a pressure side top slot on a pressure side of the camber-line rib and whereby the camber-line rib creates a suction side top slot on a suction side of the camber-line rib; and at least one rib cooling channel positioned in the camber-line rib and in fluid communication with the at least one cavity forming the cooling system in the blade;

wherein the at least one rib cooling channel includes a linear portion that is aligned generally with a radially outer surface of the camber-line rib;

wherein the at least one rib cooling channel includes a cooling fluid feed portion that is nonparallel and nonorthogonal relative to the linear portion of the at least one rib cooling channel and in direct contact with the at least one cavity forming a cooling system in the blade; and wherein the cooling fluid feed portion is linear and extends from the at least one cavity forming a cooling system in the blade to an outer surface of the camber-line rib, wherein a plug is positioned in the cooling fluid feed portion at the intersection of the cooling fluid feed portion and the outer surface of the camber-line rib.

2. The turbine blade of claim 1, wherein the at least one rib cooling channel includes an exhaust opening in the trailing edge of the generally elongated blade for exhausting cooling fluids.

3. The turbine blade of claim 1, wherein the at least one rib cooling channel includes an exhaust opening in the trailing edge of the camber-line rib for exhausting cooling fluids.

4. The turbine blade of claim 1, wherein the linear portion of the at least one rib cooling channel is aligned radially with pressure and suction side top slots.

5. The turbine blade of claim 1, wherein the at least one rib cooling channel is positioned along a centerline of the camber-line rib.

6. The turbine blade of claim 1, further comprising a forward tip rib extending radially from an outer surface of the tip of the generally elongated blade and at a perimeter of the blade such that a pocket is formed within the forward tip rib on the outer surface of the tip wall of the generally elongated blade, wherein the forward tip rib contacts the camber-line rib at a leading edge of the camber-line rib.

7. The turbine blade of claim 1, wherein the at least one rib cooling channel includes an exhaust opening in the trailing edge of the camber-line rib for exhausting cooling fluids.

8. A turbine blade, comprising:

a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade;

a camber-line rib extending radially outward from an outer surface of the tip of the generally elongated blade, beginning at the trailing edge of the blade and extending toward the leading edge, whereby the camber-line rib creates a pressure side top slot on a pressure side of the camber-line rib and whereby the camber-line rib creates a suction side top slot on a suction side of the camber-line rib;

a forward tip rib extending radially from an outer surface of the tip of the generally elongated blade and at a perimeter of the blade such that a pocket is formed within the forward tip rib on the outer surface of the tip wall of the generally elongated blade, wherein the forward tip rib contacts the camber-line rib at a leading edge of the camber-line rib; and at least one rib cooling channel positioned in the camber-line rib and in fluid communication with the at least one cavity forming the cooling system in the blade;

wherein the at least one rib cooling channel includes an exhaust opening in the trailing edge of the generally elongated blade for exhausting cooling fluids;

wherein the at least one rib cooling channel includes a linear portion that is aligned generally with a radially outer surface of the camber-line rib;

wherein the at least one rib cooling channel includes a cooling fluid feed portion that is nonparallel and nonorthogonal relative to the linear portion of the at least one rib cooling channel and in direct contact with the at least one cavity forming a cooling system in the blade;

wherein the cooling fluid feed portion is linear and extends from the at least one cavity forming a cooling system in the blade to an outer surface of the camber-line rib, wherein a plug is positioned in the cooling fluid feed portion at the intersection of the cooling fluid feed portion and the outer surface of the camber-line rib.

9. The turbine blade of claim 8, wherein the linear portion of the at least one rib cooling channel is aligned radially with pressure and suction side top slots.

10. The turbine blade of claim 8, wherein the at least one rib cooling channel is positioned along a centerline of the camber-line rib.

11. A turbine blade, comprising:

a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade;

a camber-line rib extending radially outward from an outer surface of the tip of the generally elongated blade, beginning at the trailing edge of the blade and extending toward the leading edge, whereby the camber-line rib creates a pressure side top slot on a pressure side of the camber-line rib and whereby the camber-line rib creates a suction side top slot on a suction side of the camber-line rib;

a forward tip rib extending radially from an outer surface of the tip of the generally elongated blade and at a perimeter of the blade such that a pocket is formed within the forward tip rib on the outer surface of the tip wall of the generally elongated blade, wherein the forward tip rib contacts the camber-line rib at a leading edge of the camber-line rib;

at least one rib cooling channel positioned in the camber-line rib and in fluid communication with the at least one cavity forming the cooling system in the blade;

wherein the at least one rib cooling channel includes an exhaust opening in the trailing edge of the generally elongated blade for exhausting cooling fluids;

wherein the at least one rib cooling channel includes a linear portion that is aligned generally with a radially outer surface of the camber-line rib; and wherein the at least one rib cooling channel includes a cooling fluid feed portion that is nonparallel and nonorthogonal relative to the linear portion of the at least one rib cooling channel and in direct contact with the at least one cavity forming a cooling system in the blade;

wherein the exhaust opening is positioned in the trailing edge of the camber-line rib for exhausting cooling fluids;

wherein the linear portion of the at least one rib cooling channel is aligned radially with pressure and suction side top slots;

wherein the at least one rib cooling channel is positioned along a centerline of the camber-line rib;

wherein the cooling fluid feed portion is linear and extends from the at least one cavity forming a cooling system in the blade to an outer surface of the camber-line rib, wherein a plug is positioned in the cooling fluid feed portion at the intersection of the cooling fluid feed portion and the outer surface of the camber-line rib.

* * * * *